US006386726B1

(12) United States Patent
Macierowski et al.

(10) Patent No.: US 6,386,726 B1
(45) Date of Patent: May 14, 2002

(54) EXPANDABLE BATON WITH INTEGRATED MACE AND LIGHT

(76) Inventors: Glenn E. Macierowski, 23 Olive Rd., Sparta, NJ (US) 07871; Eric J. Goleskie, 10 Pine St., Greenbrook, NJ (US) 08812

( * ) Notice: Subject to any disclaimer, the term of this patent is extended or adjusted under 35 U.S.C. 154(b) by 0 days.

(21) Appl. No.: 09/635,556

(22) Filed: Aug. 10, 2000

Related U.S. Application Data

(63) Continuation-in-part of application No. 09/449,938, filed on Nov. 29, 1999, now abandoned.
(60) Provisional application No. 60/163,263, filed on Nov. 3, 1999.

(51) Int. Cl.[7] ..... A45B 3/02

(52) U.S. Cl. ..... 362/102; 362/96; 463/47.6

(58) Field of Search ..... 362/102, 96, 109, 362/191, 253; 463/47.61; 42/1.16

(56) References Cited

U.S. PATENT DOCUMENTS

| | | | |
|---|---|---|---|
| 5,086,377 A | 2/1992 | Roberts | 362/102 |
| 5,160,140 A | 11/1992 | Starrett | |
| 5,347,436 A | 9/1994 | Clyde et al. | 362/102 |
| 5,363,285 A | 11/1994 | Wideman | |
| 5,405,134 A | 4/1995 | Wolfram | 362/102 |

*Primary Examiner*—Stephen Husar
(74) *Attorney, Agent, or Firm*—Richard C. Litman

(57) ABSTRACT

A hand-held personal defense/police baton comprising an elongated, telescoping main cylinder having an extendable first end and a second end comprising a rounded, shatter-proof light that is secondarily useable for jabbing maneuvers. Proximate the second end is a mushroom-shaped side handle that extends transverse to the main cylinder. The side handle houses a pressurized chemical spray canister operated by a push button and having safety features to prevent accidental discharge. The side handle also has a dome-shaped locking top that conceals the push button and canister, and that may be properly used in striking maneuvers. Multiple embodiments of the closure and lock are disclosed.

17 Claims, 7 Drawing Sheets

EXPANDABLE BATON WITH INTEGRATED MACE AND LIGHT

CROSS-REFERENCE TO RELATED APPLICATION

This application is a Continuation-In-Part of application Ser. No. 09/449,938, filed Nov. 29, 1999, now abandoned, which claims the benefit of U.S. Provisional Patent Application No. 60/163,263, filed Nov. 3, 1999.

BACKGROUND OF THE INVENTION

1. Field of the Invention

The present invention relates to expandable police batons. More specifically, the invention is an expandable baton having an integrated shatter-proof light and a pressurized spray canister for dispensing a chemical agent, such as mace.

2. Description of Related Art

The use of flashlights, clubs, extendable batons, and chemical irritants for use by security personnel, the police and military are well known. Previously, however, such devices were largely independent of each other. Prior attempts have been made to combine various elements into one device. These attempts have met with limited success. One reason for this, among others, is that it is unlawful or against public policy in many jurisdictions for police to use flashlights, per se, i.e., modified flashlights, as clubs. There are additional problems relating to the balance required of a baton that is difficult to achieve with respect to modified flashlights. Moreover, previous multi-faceted police batons have heretofore lacked certain safety features, such as arcuate striking surfaces (rather than surfaces having sharp angles that can cause unnecessary gashes in the skin), and means to prevent accidental discharge of any chemical irritants.

The related art discussed below is representative of developments in the art.

U.S. Pat. No. 5,086,377, issued to Roberts on Feb. 4, 1992, describes a defense baton having a light and a replaceable spray canister. However, there is no short side handle and it does not operate with the versatility of a regular police baton. Roberts, thus, does not teach the present invention as claimed.

U.S. Pat. No. 5,160,140, issued to Starrett on Nov. 3, 1992, describes an expandable police baton. Starrett does not disclose a lamp or a chemical sprayer and therefore, it does not teach the present invention as claimed.

U.S. Pat. No. 5,347,436, issued to Clyde et al. on Sep. 13, 1994, describes a combination baton/light emitting device. The Clyde device does not have a spray canister or a telescoping extension. Clyde does not teach the present invention as claimed.

U.S. Pat. No. 5,363,285, issued to Wideman on Nov. 8, 1994, describes a baton and flashlight assembly. The baton is not telescoping and does not have a sprayer. Thus, Wideman does not teach the present invention as claimed.

U.S. Pat. No. 5,405,134, issued to Wolfram on Apr. 11, 1995, describes a gas ejecting handle attachment for flashlights. Wolfram does not have a swiveling top, or a push button safety mechanism to protect the officer from having the device used against him or her. Moreover, the Wolfram baton is not extendable. Finally, Wolfram is not designed with rounded striking surfaces at each of its three extremities. In fact, it is unlawful in many jurisdictions for flashlights, per se, to be used as clubbing batons. In addition, flashlights do not provide the proper balance required for a police baton. Therefore, Wolfram does not teach the present invention as claimed.

None of the above inventions and patents, taken either singly or in combination, is seen to describe the instant invention as claimed.

SUMMARY OF THE INVENTION

The present invention is a hand-held personal defense baton comprising an elongated, hollow, telescoping, horizontal main cylinder having an extendable first end and a second end comprising a rounded, shatter-proof light that is secondarily useable for jabbing maneuvers. Proximate the second end is a mushroom-shaped side handle that extends vertically from the main cylinder. The side handle houses a pressurized canister operated by a push button having dual safety features. The push button effectuates a chemical spray through an integral nozzle aimed in the same general direction as the light. The side handle also has a dome-shaped top that conceals the push button and canister, and that may be properly used in jabbing and other police baton-style maneuvers. In sum, each of the three extremities of the baton has a dual function that includes inflicting blows.

Accordingly, it is a principle object of the invention to provide an expandable baton having a concealable pressurized spray canister that sprays a chemical irritant in the general direction of the short handle of the baton.

It is another object of the invention to provide an expandable personal defense baton having a shatter-proof light comprising an integral, curved jabbing surface without sharp angular edges, where the light illuminates in the general direction of the short handle of the baton.

It is a further object of the invention to provide an expandable baton having a side handle containing a pressurized canister utilizing a push button safety mechanism.

It is yet another object of the invention to provide an expandable baton having a side handle containing a pressurized spray canister beneath a rounded, soft-lock, top, wherein the side handle may be alternately, safely and properly used as a jabbing surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
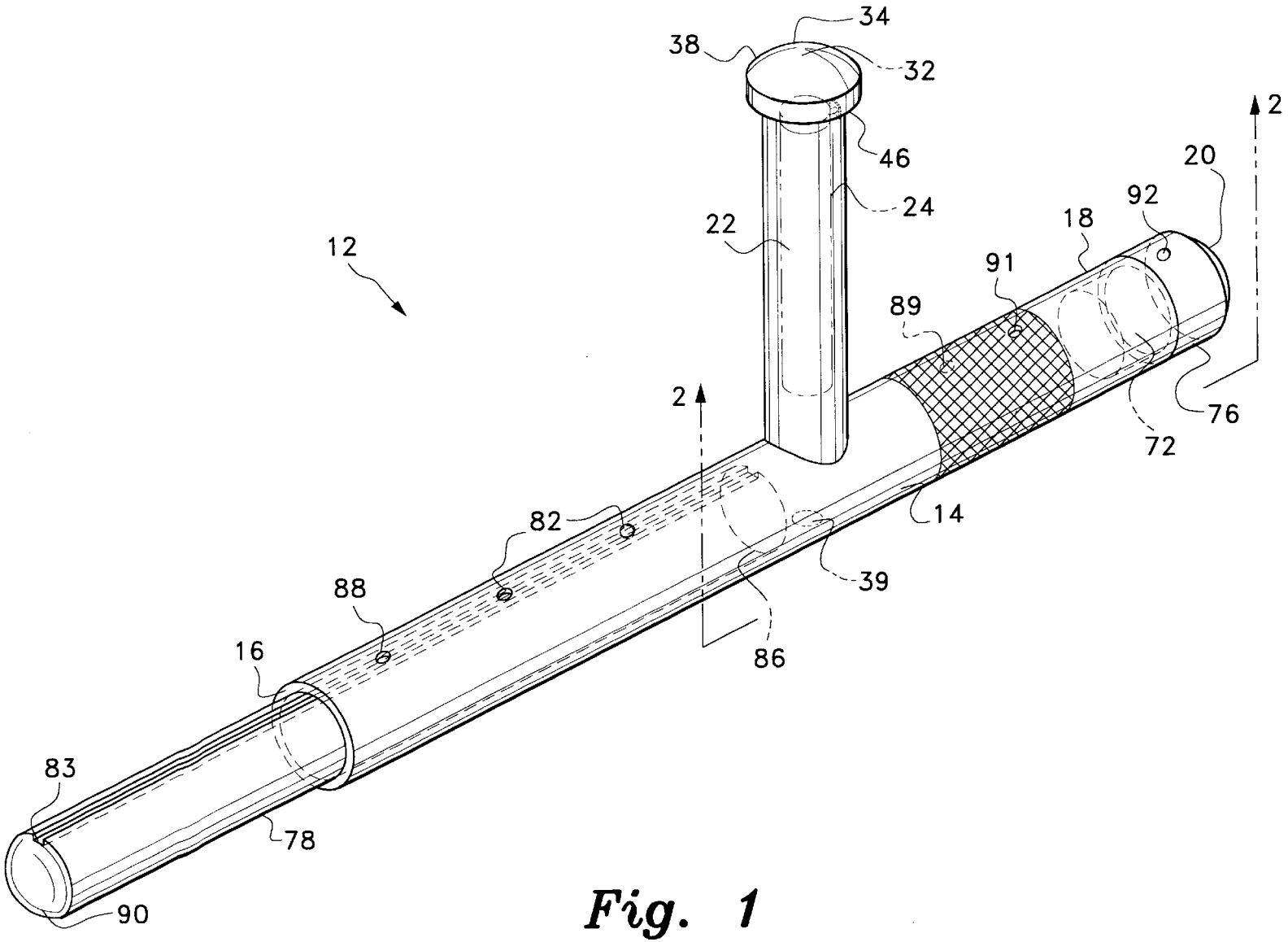
FIG. 1 is a perspective view of a first embodiment of an expandable baton with integrated mace and light according to the present invention.

As best shown in FIG. 1, the present invention is an expandable, extendable, hand-held personal defense/police baton 12 with integrated mace and light features. Although FIG. 1 shows the first embodiment, of the baton 12, it is noted that the second embodiment of the baton 12A (seen in FIGS. 4 and 5) would have the identical appearance to the view shown in FIG. 1. The differences between the two embodiments, as discussed below, is in the side handles 22 and 22A and their interior features, which are not shown in FIG. 1.

Baton 12 comprises an elongated, telescoping, horizontal main cylinder 14 having an extendable first end 16, and a second end 18 including a fixture that is preferably a shatter-proof light 20. A mushroom-shaped side handle 22 extends transversely from main cylinder 14 proximate second end 18. Side handle 22 contains a pressurized canister 24 having a fluid projecting nozzle 26. A canister push button 28 effectuates fluid communication between canister 24 and nozzle 26. Canister 24 preferably contains a chemical eye irritant, such as Mace®. Each end 16, 18 of main cylinder 14, as well as side handle 22, may be used for standard jabbing maneuvers employed by law enforcement and/or in self defense. Each of these three baton extremities also has at least a dual function, as further described.

Figure 2:
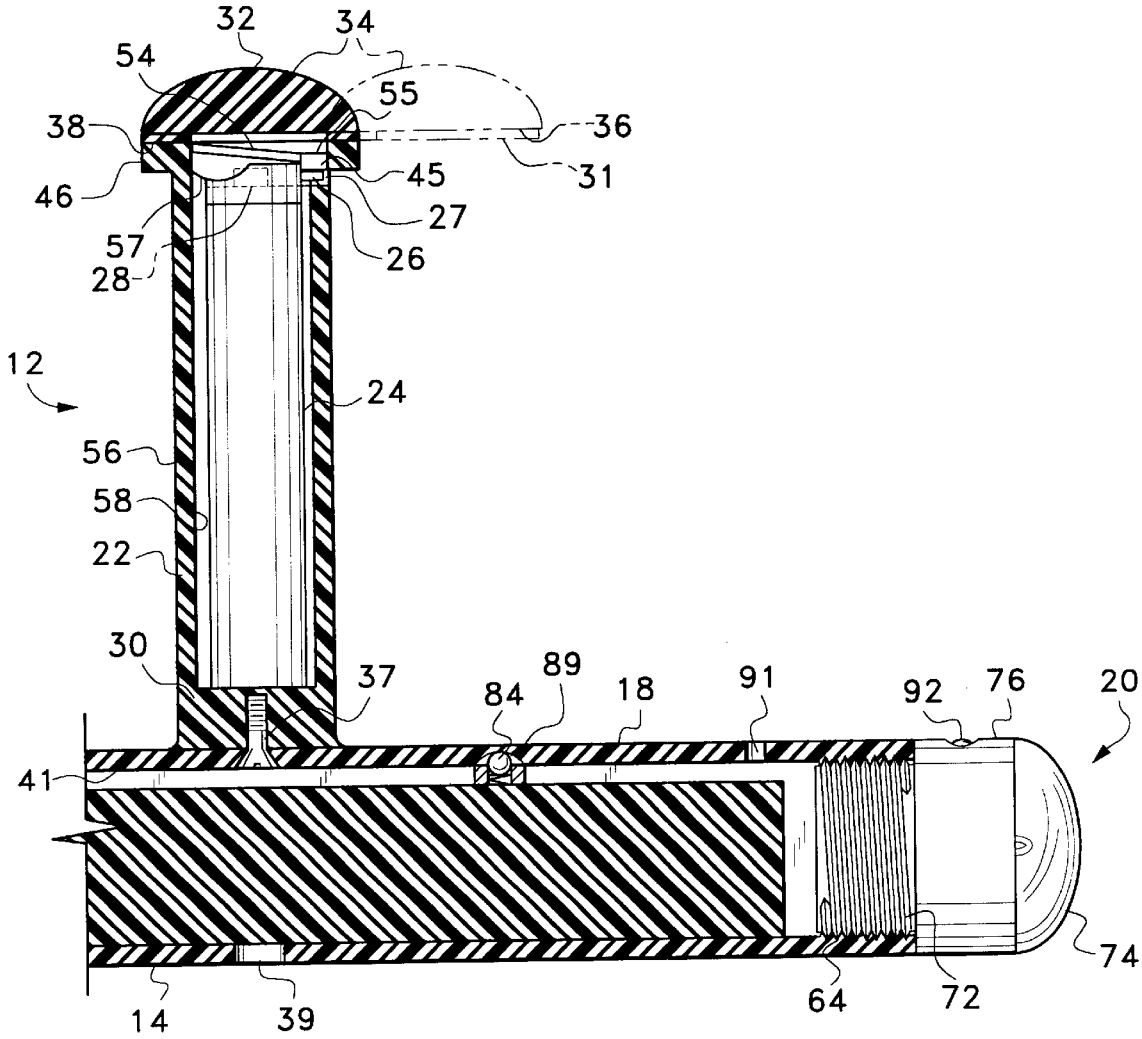
FIG. 2 is a sectional view of the first embodiment of a baton side handle and light.

As best shown in FIG. 2, side handle 22 comprises a mounting base 30 adjacent main cylinder 14. Preferably, side handle 22 is affixed to main cylinder 14 with an internal flat head bolt 37 that is fastened to an inside wall 41 of main cylinder 14 and that extends through mounting base 30 of side handle 22. Access to bolt 37 is gained by extending extension member 78 through cylinder 14 so that the proximal end 86 of extension member 78 clears the shaft of the side handle 22. A tool can then be inserted through opening 39 to reach the head of bolt 37. Side handle 22 could also easily be welded to cylinder 14.

A solid, semi-spherical closure top 32, opposite base 30, resembles the cap of a mushroom. Closure top 32 has a curved upper surface 34, a flat, horizontal lower surface 36, and a perimeter edge 38 connecting lower surface 36 to said upper surface 34. Closure top 32 is capable of sliding forward toward second end 18 and in a reverse direction toward first end 16 in a horizontal plane across the top of collar 46.

This sliding of the closure top 32 is best explained with reference to FIGS. 3A and 3B. A rail 31 on either side of the lower surface 36 of the closure top 32 engages a rail groove 43 on either side of the upper surface of the collar 46. Each rail 31 has a protrusion 33, which engages an internal protrusion groove 47 within each rail groove 43.

From the position in which the closure top 32 is in place on the collar 46, the top 32 can be slid forward toward the second end 18 along the rails 31 and the rail grooves 43. However, the internal protrusion grooves 47 do not extend the complete length of the rail grooves 43, effectively acting as a stop by stopping the forward motion of the protrusions 33 and, therefore, the cap 32. This stop mechanism ensures that the cap 32 will remain attached to the collar 46 when it is pushed forward to expose the canister 24 during operation. The internal protrusion grooves 47 extend to the end of the collar proximate the first end 16, allowing the cap 32 to be removed from the collar 46 when it is moved rearwardly for re-loading another canister 24.

Top 32 is held in place on the collar 46 by a "soft-lock", a lock which may be opened with slight pressure from the thumb of the hand which grips handle 22. The lower surface 36 of the top 32, has a pair of camming grooves 42 extending parallel to and closer to the perimeter edge 38 than the rails 31. Each of the camming grooves 42, which extends completely across the lower surface 36, is relatively shallow and includes a deeper socket 44 at its center.

In operation, as the closure top 32 is slid from its open to its closed position, the spring-loaded balls 40 engage and partially depress into camming grooves 42. When top 32 is fully closed, balls 40 fully occupy sockets 44 so as to lock closed closure top 32.

Side handle stem 56 connects collar 46 to main cylinder 14. Stem 56 has formed therein a cylindrical chamber 58 which houses canister 24. A dispensing port is disposed beneath and adjacent to collar 46. The dispensing port comprises a small hole 27 through a wall portion of chamber 58, facing second end 18 of main cylinder 14 such that nozzle 26 dispenses the Mace®, or other chemical irritant, in an essentially horizontal stream, essentially parallel to the longitudinal axis of main cylinder 14.

Figure 3A:
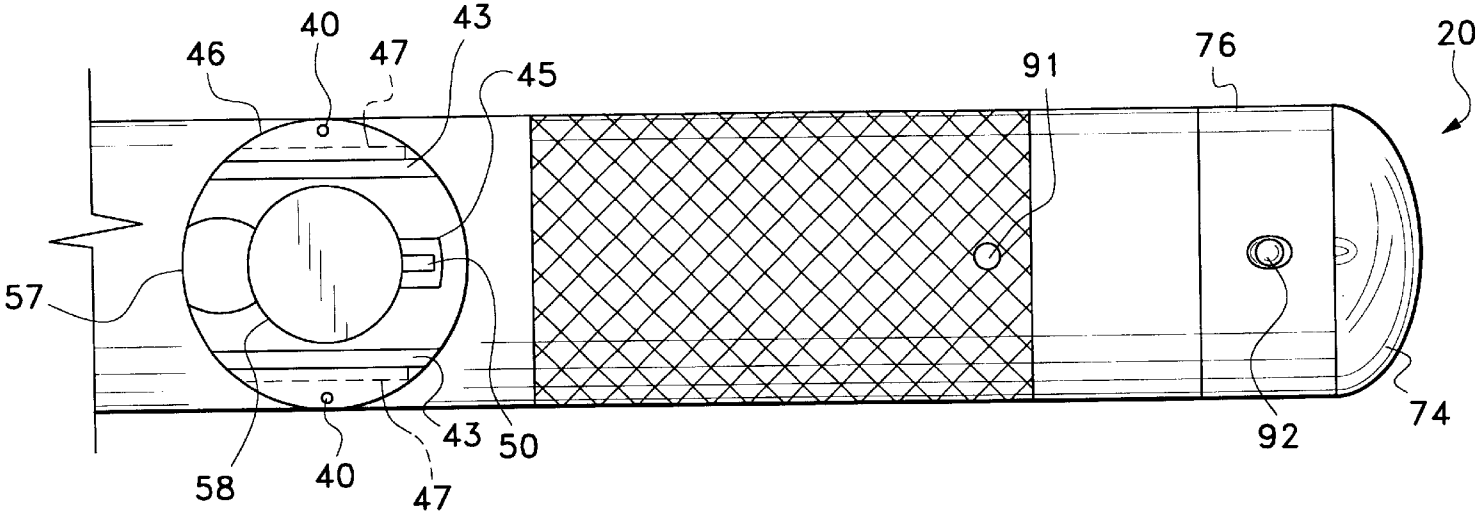
FIG. 3A is a top view of the first embodiment of the baton side handle.
Figure 3B:
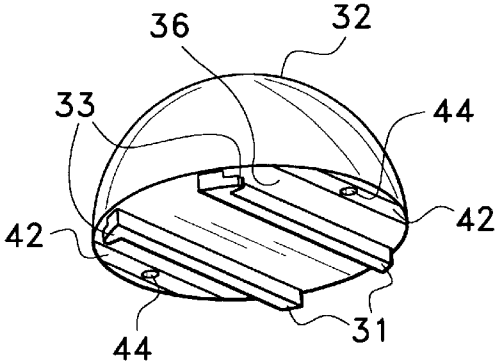
FIG. 3B is a perspective view of a closure top used with the first embodiment of the baton side handle.
Figure 3C:
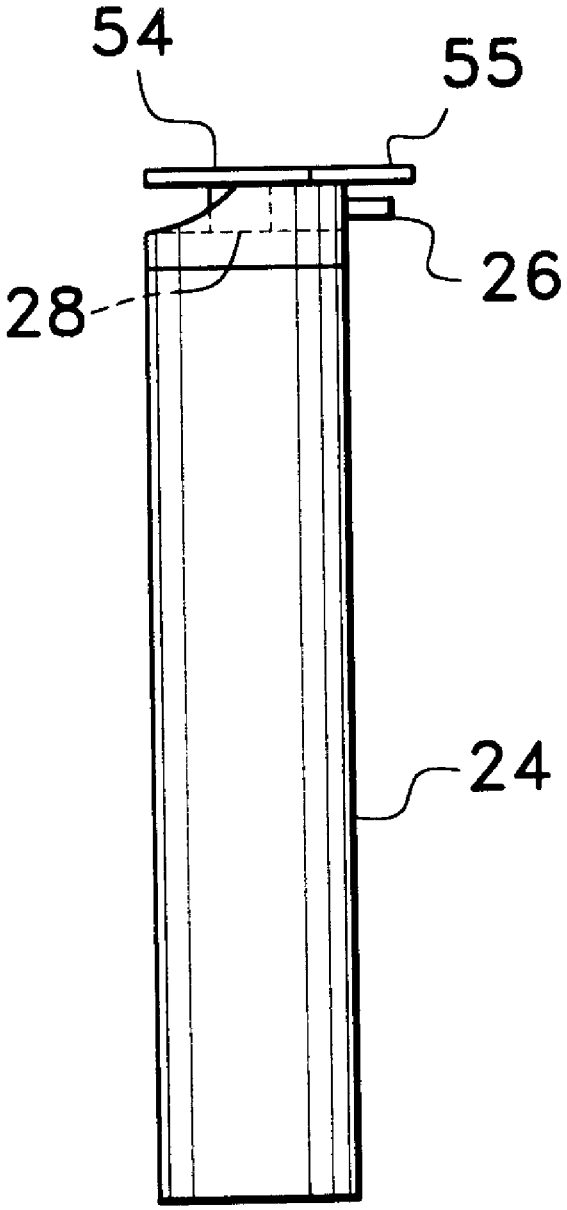
FIG. 3C is a side view of a pressurized canister use with the first embodiment of the baton side handle.

Referring to FIG. 3C, which shows a customized pressurized canister 24, it can be seen how the canister 24 is securely held in place by the collar 46. The locking flap 55 and the nozzle 26 fit into the square depression 45 and the locking notch 50 (shown in FIG. 3A), respectively, of the collar 46. The insertion of the locking flap 55 into the square depression 45 prevents the canister 24 from moving in any direction when the closure top 32 is in either a closed position or pushed forward toward end 18 for use.

Additionally, the chamber 58 and the canister 24 are produced with zero tolerances to prevent any movement of the canister 24 after it is placed in service. These safety measures are further enhanced by a safety mechanism 54, which tops push button 28, and is preferably integral with canister 24. Safety mechanism 54 is a latch that is lifted with the thumb that operates push button 28. Safety mechanism 54, in conjunction with closure top 32, prevents accidental discharge of canister 24. Another feature of the canister 24 is that its upper portion is sloped to allow easy access to the button 28 from the thumb depression 57 in the collar 46.

Figure 4:
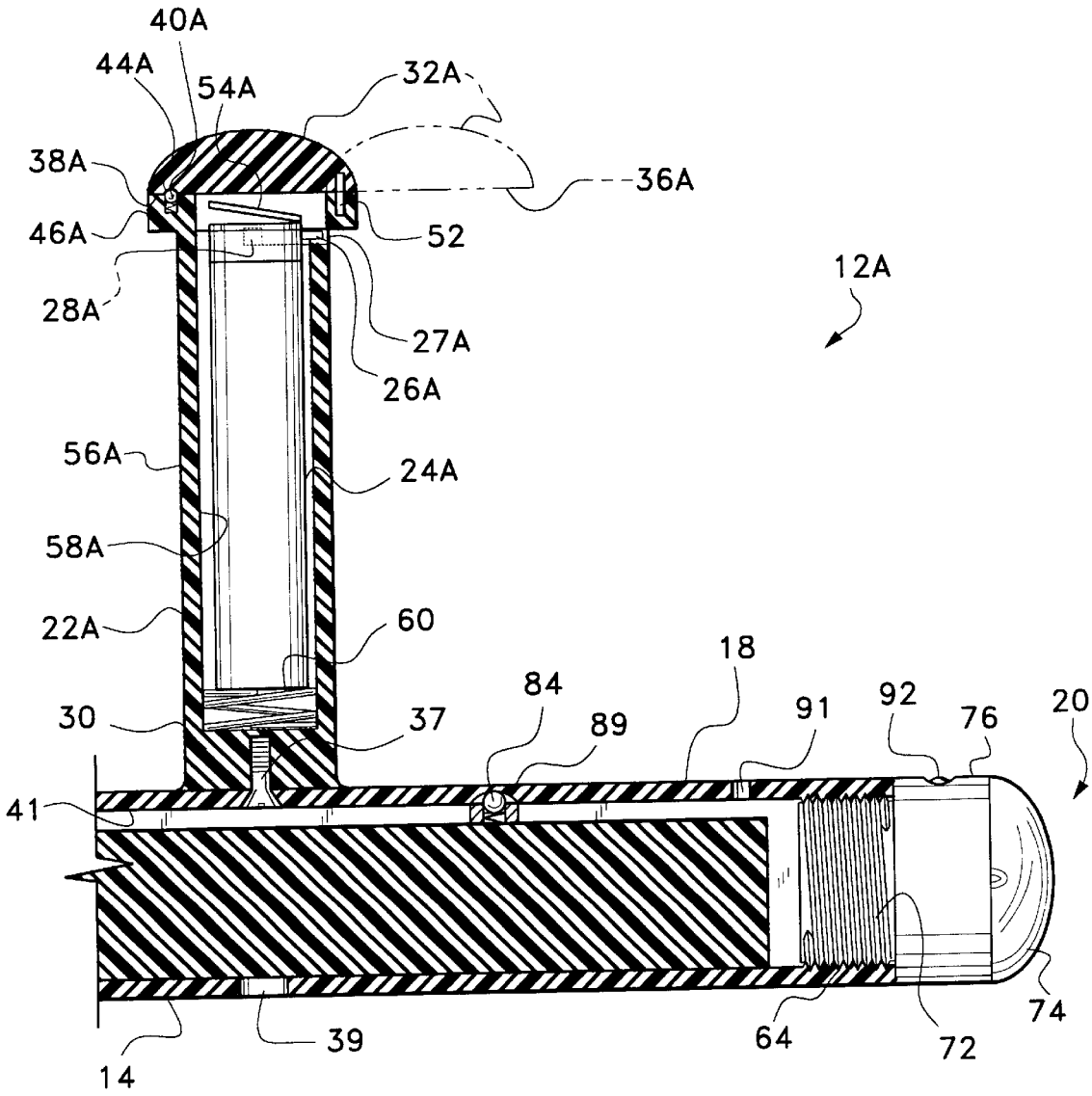
FIG. 4 is a sectional view of a second embodiment of the baton side handle and light.
Figure 5:
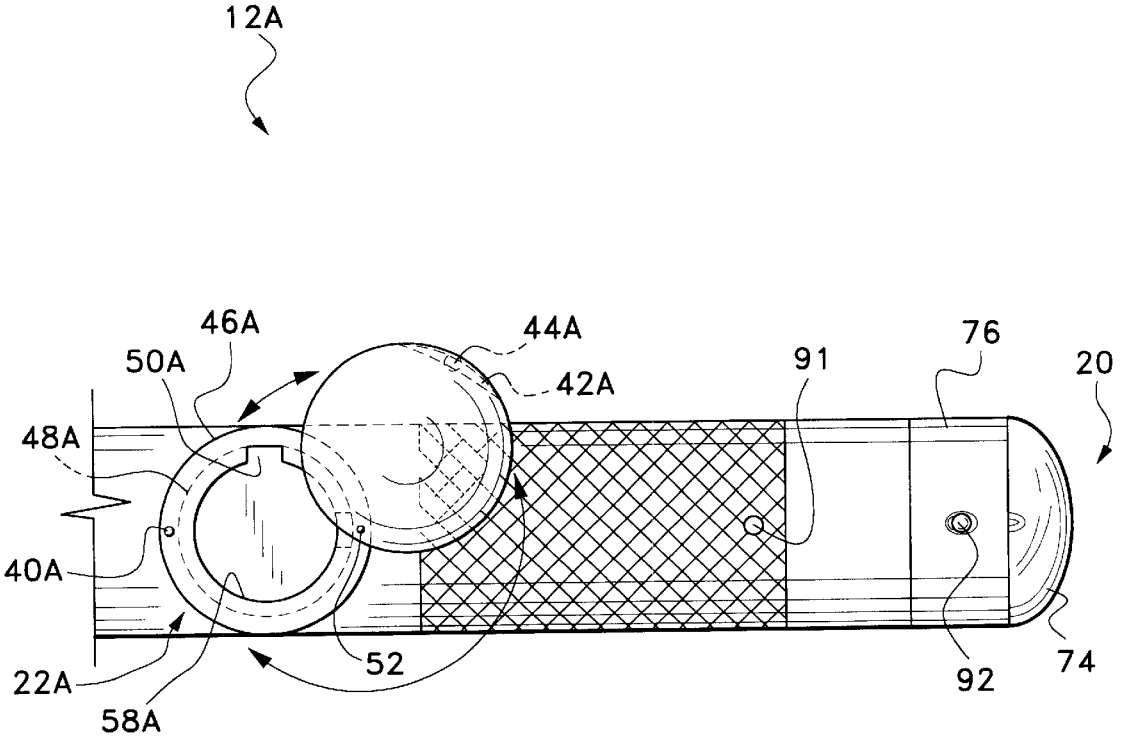
FIG. 5 is a top view of the second embodiment of the baton side handle.

A second embodiment of side handle 22A is seen in FIGS. 4 and 5, which are analogous to FIGS. 2 and 3A of the first embodiment. In this embodiment, the closure top 32A swivels to expose the canister 24A. The canister 24A includes a nozzle 26A, which dispenses fluid in the same manner as in the first embodiment through dispensing port opening 27A. Push button 28A and safety mechanism 54A are similar to the corresponding features of canister 24. However, canister 24A does not have a locking flap 55 such as that of canister 24 to hold it in place. Rather, a canister spring 60 seated upon mounting base 30 urges canister 24A upwards against the lower surface of the collar 46A.

The closure top 32A is capable of swiveling 360° in a horizontal plane about a hinge pin 52 extending through top 32A, proximate perimeter edge 38A. Lower surface 36A has formed therein a shallow camming groove 42A extending to perimeter edge 38A of top 32A from either side of a socket 44A proximate perimeter edge 38A. Socket 44A is disposed 180° opposite hinge pin 52.

Closure top 32A is swivelably hinged to, and seated upon, cylindrical collar 46A. Collar 46A also has the same diameter as closure top 32A. Collar 46A maintains a ring-shaped perimeter wall 48A. Wall 48A has formed therein a canister lock notch 50A. Wall 48A also features an inlaid spring lock ball 40A that is vertically biased into engagement with camming groove 42A, and with socket 44A of closure top 32A. In operation, as the closure top 32A is swiveled from its open to its closed position, the spring loaded ball 40A engages camming groove 42A, and ball 40A partially depresses into perimeter wall 48A. When top 32A is fully closed, ball 40A fully occupies socket 44A so as to lock closure top 32A. It is a "soft-lock" because top 32A may be opened with slight lateral pressure from a thumb of the hand that grips handle 22A.

Side handle stem 56A connects collar 46A to main cylinder 14. Stem 56A has formed therein a cylindrical chamber 58A which houses canister 24A. Chamber 58A is defined by an inside wall surface that is flush with an inner-most edge of canister lock notch 50A. A protrusion on canister 24A is introduced into lock notch 50A. Then canister 24A is rotated such that the canister protrusion serves to lock canister 24A into operating position just below perimeter wall 48A of collar 46A.

Referring to the embodiments shown in FIGS. 1–5, light 20 has an externally threaded shank 72. Light 20 further comprises a high strength, shatter-proof (preferably plexiglass) lens 74 at its free end. Lens 74 may be used to vigorously jab at bone, or like material, without cracking or shattering lens 74. Between shank 72 and lens 74 of light 20 is a light housing 76, containing a light source, preferably a shock-resistant battery (within housing 76) that is either rechargeable or disposable. Housing 76 is preferably made from the same material as the housing for main cylinder 14, which is preferably metal. It may also be formed from a hard, damage resistant plastic, ceramic, hard rubber, or any other material suitable for making a police baton, and capable of withstanding rough blows by military and law enforcement officers. Light housing 76, once light 20 is screwed into place, is flush, i.e. maintains a smooth transition, with main cylinder 14. Recessed button switch 92, formed inside light housing 76, activates and deactivates light 20. A twist or slide switch may be used so that it does not interfere with the normal operation of the baton.

Figure 6:
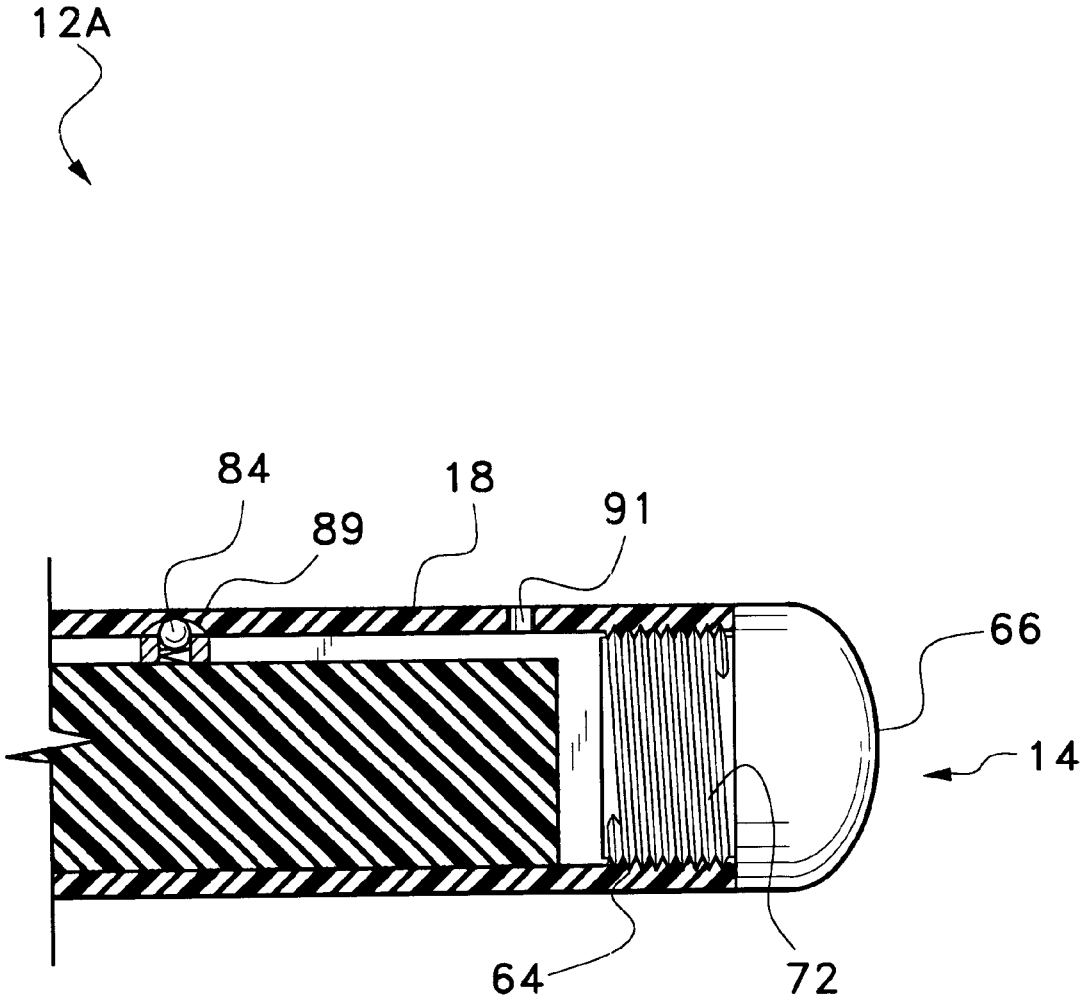
FIG. 6 is a fragmented side view, partly in section, of an alternate embodiment of the baton handle with a cleanout cap in place of a light.

In an alternative embodiment shown in FIG. 6, a rounded cleanout cap 66 is used in place of light 20. According to this embodiment, a cleanout cap 66 having a rounded butt end is connected to externally threaded cylindrical shank 72 such that the butt end maintains a smooth interface with main cylinder 14.

In all embodiments, a telescoping extension member 78 protrudes from first end 16 of main cylinder 14, preferably enabling the main cylinder to increase in length up to sixteen inches. Extension member 78 is subject to guide means disposed on a surface of main cylinder 14. Preferably those guide means include at least two pins 82 extending radially inward from an inside wall of main cylinder 14, proximate first end 16. Pins 82 engage a channel 83 formed on the surface, and along the length, of extension member 78 for stable deployment of extension member 78.

Extension member 78 also includes locking means, to lock it in at least two alternate positions. The locking means are preferably a spring-loaded button 84 mounted inside a proximal end 86 of extension member 78. Button 84 engages a hole 88 near first end 16, and button 84 also engages button cavity 89 near second end 18 of main cylinder 14 to secure extension member 78 in a first position and a second position.

The first position (the extension member 78 is retracted) is where the proximal end 86 of said extension member 78 is affixed to, and inside, second end 18 of said main cylinder 14, whereas a distal end 90 of member 78 extends slightly beyond first end 16 of main cylinder 14. The second position (the extension member 78 is fully extended) is where proximal end 86 is affixed to, and inside, first end 16, whereas distal end 90 extends substantially beyond said first end 16.

Pressure release hole 91 is located on main cylinder 14 proximate second end 18, but does not intersect shank 72. Release hole 91 allows air in and out of main cylinder 14 as extension member 78 extends and retracts through cylinder 14.

It is to be understood that the present invention is not limited to the sole embodiments described above, but encompasses any and all embodiments within the scope of the following claims.

We claim:

1. A hand-held personal defense baton, comprising:

an elongated, hollow, telescoping, horizontal main cylinder having an extendable first end and a second end comprising a hard, rounded fixture for high-impact police maneuvers; and a mushroom-shaped side handle extending vertically from said main cylinder, proximate said second end, said side handle having disposed therein a pressurized canister with a fluid projecting nozzle, and a push button that effectuates fluid communication between said pressurized canister and said nozzle, wherein said nozzle expels fluid through a dispensing port in said side handle, said side handle further includes a locking closure top that conceals said canister and one or more ball and socket locking means for locking said closure top.

2. The device according to claim 1, wherein said fixture comprises a high strength, shatter-proof lens connected to a housing that contains a shock-resistant light source.

3. The device according to claim 1, further including a safety mechanism on said push button to prevent accidental discharge of contents of said canister.

4. The device according to claim 3 wherein said side handle includes a hinge pin about which said locking closure top can swivel.

5. The device according to claim 1, wherein said side handle further comprises:

a mounting base adjacent said main cylinder;

a solid, semi-spherical closure top, opposite said mounting base, said closure top having a curved upper surface, a flat, horizontal lower surface, and a perimeter edge connecting said lower surface to said upper surface, said closure top capable of swiveling 360 degrees in a horizontal plane about a hinge pin extending through said top, proximate said perimeter edge, said lower surface having formed therein a shallow camming groove extending to said perimeter edge of said top from either side of a socket proximate said perimeter edge, said socket disposed 180 degrees opposite said hinge pin;

a cylindrical collar to which is swivelably hinged, and upon which is seated, said closure top, said collar having the same diameter as said closure top and maintaining an annular perimeter wall, said wall having formed therein a canister lock notch, said wall also supporting an inlaid spring lock ball that is vertically biased into engagement with said shallow groove and said socket of said closure top;

a safety mechanism topping said push button to prevent accidental discharge of the contents of said canister, said push button and said safety mechanism housed within said cylindrical collar;

a side handle stem connecting said collar to said main cylinder, said stem having a cylindrical chamber formed therein to house said canister, said chamber defined by an inside wall surface that is flush with an inner-most edge of said canister lock notch;

a canister spring seated upon said mounting base urging said canister upwards against a bottom surface of said collar; and a dispensing port disposed beneath and adjacent to said cylindrical collar, said port comprising a small hole through a wall portion of said chamber facing said second end of said main cylinder such that said nozzle dispenses a fluid in an essentially horizontal stream and essentially parallel to the longitudinal axis of said main cylinder.

6. The device according to claim 1, wherein said main cylinder further comprises:

threads formed on said second end of said main cylinder to threadedly receive said rounded fixture, one of said second end and said fixture having an externally threaded shank and the other of said second end and said fixture having internal threads, said fixture further comprising a high strength, shatter-proof lens, a shock-resistant battery, and a cylindrical light housing;

a telescoping extension member protruding from said first end of said main cylinder;

extension member guide means for stable deployment of said extension member; and extension member locking means to secure said extension member in at least two positions.

7. The device according to claim 1, wherein said main cylinder further comprises:

threads formed on said second end of said main cylinder to threadedly receive said rounded fixture, wherein said fixture is a cleanout cap having a rounded butt end;

a telescoping extension member protruding from said first end of said main cylinder;

extension member guide means for stable deployment of said extension member; and extension member locking means to secure said extension member in at least two positions.

8. A hand-held personal defense baton, comprising:

an elongated, hollow, telescoping, horizontal main cylinder having an extendable first end and a second end comprising a hard, rounded fixture for high-impact police maneuvers; and a mushroom-shaped side handle extending vertically from said main cylinder, proximate said second end, said side handle having disposed therein a pressurized canister with a fluid projecting nozzle, and a push button that effectuates fluid communication between said pressurized canister and said nozzle, wherein said nozzle expels fluid through a dispensing port in said side handle, said side handle further including a locking closure top that conceals said canister and rails and grooves on which said closure top can slide.

9. The device according to claim 8 wherein said rails and grooves include a stop means limiting the movement of said closure top.

10. A hand-held personal defense baton, comprising:

an elongated, hollow, telescoping, horizontal main cylinder having an extendable first end and a second end comprising a light; and a mushroom-shaped side handle extending vertically from said main cylinder, proximate said second end, said side handle having a pressurized canister comprising a fluid projecting nozzle and a canister push button that effectuates fluid communication between said pressurized canister and said nozzle;

said side handle further comprising:

a mounting base adjacent said main cylinder;

a solid, semi-spherical closure top, opposite said mounting base, said closure top having a curved upper surface, a flat, horizontal lower surface, and a perimeter edge connecting said lower surface to said upper surface;

a cylindrical collar upon which is seated said closure top;

a safety mechanism topping said push button to prevent accidental discharge of the contents of said canister;

side handle stem connecting said collar to said main cylinder, said stem having a cylindrical chamber formed therein to house said canister;

a dispensing port disposed beneath and adjacent to said cylindrical collar, said port comprising a small hole through a wall portion of said chamber facing said second end of said main cylinder such that said nozzle dispenses a fluid in an essentially horizontal stream and essentially parallel to the longitudinal axis of said main cylinder;

said main cylinder further comprises:

threads formed on said second end of said main cylinder to threadedly receive said light, one of said second end and said light having an externally threaded shank and the other of said second end and said light having internal threads, such that upon mating said second end and said light an outer surface of said light is flush with said main cylinder, said light further comprising:

a high strength, shatter-proof lens;

a shock-resistant battery; and a cylindrical light housing;

a telescoping extension member protruding from said first end of said main cylinder;

extension member guide means for stable deployment of said extension member; and extension member locking means to secure said extension member in at least two positions.

11. The device according to claim 10 further including rails and grooves positioned on said closure top and said collar, whereby said closure top is slidable relative to said collar.

12. The device according to claim 11 wherein said rails and grooves include a stop means limiting the movement of said closure top.

13. The device according to claim 11 further including two sets of balls and sockets and camming grooves adjacent to said sockets positioned on said closure top and said collar, whereby said closure top can be locked into place on said collar.

14. The device according to claim 10 wherein said collar includes a depression and said canister includes a locking flap for mating with said depression to secure said canister.

15. The device according to claim 10 wherein said collar includes a locking notch for mating with said nozzle of said canister to secure said canister.

16. The device of claim 10 further including a hinge pin about which said closure top is capable of swiveling 360 degrees in a horizontal plane, said hinge pin extending into said top, proximate said perimeter edge, said lower surface of said top having formed therein a shallow camming groove extending to said perimeter edge of said top from either side of a socket proximate said perimeter edge, said socket disposed opposite said hinge pin;

said collar having an annular perimeter wall having formed therein a canister lock notch, said wall also supporting an inlaid spring lock ball that is vertically biased into engagement with said shallow groove and said socket of said closure top; and a canister spring seated upon said mounting base urging said canister upwards against a bottom surface of said collar.

17. A hand-held personal defense baton, comprising:

an elongated, hollow, telescoping, horizontal main cylinder having an extendable first end and a second end comprising a hard, rounded fixture for high-impact police maneuvers; and a mushroom-shaped side handle extending vertically from said main cylinder, proximate said second end, said side handle having disposed therein a pressurized canister with a fluid projecting nozzle, and a push button that effectuates fluid communication between said pressurized canister and said nozzle, wherein said nozzle expels fluid through a dispensing port in said side handle;

threads formed on said second end of said main cylinder to threadedly receive said rounded fixture, one of said second end and said fixture having an externally threaded shank and the other of said second end and said fixture having internal threads, said fixture further comprising a high strength, shatter-proof lens, a shock-resistant battery, and a cylindrical light housing;

a telescoping extension member protruding from said first end of said main cylinder;

extension member guide means for stable deployment of said extension member; and extension member locking means to secure said extension member in at least two positions.

* * * * *